US005489153A

United States Patent [19]

Berner et al.

[11] Patent Number: 5,489,153

[45] Date of Patent: Feb. 6, 1996

[54] STATIC MIXER ASSEMBLY WITH DEFLECTION ELEMENTS

[75] Inventors: Gerhard Berner, Hessdorf-Hannbach; Günther Pröbstle, Erlangen; Wolfgang Herr, Hirschaid; Lothar Balling, Fürth, all of Germany

[73] Assignee: Siemens Aktiengesellschaft, Munich, Germany

[21] Appl. No.: 180,441

[22] Filed: Jan. 12, 1994

Related U.S. Application Data

[63] Continuation of PCT/DE92/00549, July 2, 1992.

[30] Foreign Application Priority Data

Jul. 12, 1991 [DE] Germany ..... 41 23 161.9

[51] Int. Cl.[6] ..... B01F 5/06

[52] U.S. Cl. ..... 366/337

[58] Field of Search ..... 366/336, 337, 366/340; 48/189.4; 138/37, 39, 42

[56] References Cited

U.S. PATENT DOCUMENTS

| | | | |
|---|---|---|---|
| 616,052 | 12/1898 | Brown | 366/337 X |
| 2,561,457 | 7/1951 | Beales et al. | 138/42 X |
| 2,567,998 | 9/1951 | Griffith | 138/42 |
| 3,863,678 | 2/1975 | Pettersson et al. | 138/37 |

FOREIGN PATENT DOCUMENTS

| | | |
|---|---|---|
| 1372655 | 8/1964 | France . |
| 2340483 | 2/1974 | Germany . |
| 2522106 | 4/1982 | Germany . |
| 2642105 | 1/1983 | Germany . |
| 8700259 | 4/1987 | Germany . |
| 3920123 | 12/1990 | Germany . |
| 9000929 | 2/1990 | WIPO . |
| 9010497 | 9/1990 | WIPO . |

OTHER PUBLICATIONS

Balcke–Dürr publication Sonderdruck C56, from VGB Kraftwerkstechnik, Book 8, 1983, pp. 676–678, (Eggers et al.).

Derwent English–language Abstract to German Patent No. 39 20 123.

*Primary Examiner*—Charles E. Cooley

*Attorney, Agent, or Firm*—Herbert L. Lerner; Laurence A. Greenberg

[57] ABSTRACT

A static mixer distributes substances introduced into a flow duct as homogeneously as possible in a flow medium. The intention is to achieve complete intermixing over the shortest possible path distance. The static mixer includes a multiplicity of deflection elements which are small in relation to the diameter of the flow duct. The deflection elements are disposed in mutually parallel rows aligned transversely to the axis of symmetry of the flow duct. The deflection elements of each row are inclined equidirectionally in a direction parallel to the row and in counterdirection to the deflection elements of the respectively directly adjacent rows. The static mixer can be used for gaseous and liquid media.

10 Claims, 4 Drawing Sheets

STATIC MIXER ASSEMBLY WITH DEFLECTION ELEMENTS

CROSS-REFERENCE TO RELATED APPLICATION

This application is a Continuation of International Application Serial No. PCT/DE92/00549, filed Jul. 2, 1992, now abandoned.

BACKGROUND OF THE INVENTION

FIELD OF THE INVENTION

The invention relates to a static mixer having a plurality of deflection elements disposed in a flow duct.

Static mixers are generally installed in pipelines or in other flow ducts and serve to distribute substances that were previously introduced into the pipeline or into the flow duct, as homogeneously as possible in a flow medium. It thus enables different previously introduced gases, for example, to be mixed together. Liquid or powdery substances are also thereby able to be uniformly distributed in a gas current. In addition, the use of static mixers is also possible in liquids.

Known static mixers include one or two deflection elements, which are generally triangular metal plates, that are anchored more or less obliquely in the flow path (as is the Balke Dürr publication Sonderdruck C56, from VGB Kraftwerkstechnik H8/1983, pages 676 to 678). Such deflection elements produce violent vortices, which result in an intensive intermixing of the gas current and all added components, downstream. However, it is a peculiarity of such static mixers that the complete intermixing of the components is only achieved at a sufficiently large distance behind the static mixer or behind the deflection elements. That distance amounts, in gaseous media, to approximately 10 to 20 times the diameter of the pipe. That results in there having to be a sufficiently large amount of space present behind the deflection elements before connecting the succeeding structural elements, to which the mixture is to be fed. However, in a large number of industrial plants, that space is only very tightly dimensioned and is available in an inadequate measure.

A static mixer has also already been disclosed, in which a plurality of small deflection elements are disposed in a plane perpendicular to the axis of symmetry of the gas duct. Using such static mixers, a good mixing of the gases having been previously jet-sprayed into the gas current or substances introduced therein is already able to be achieved at a relatively short distance from the deflection elements. However, it is a peculiarity of such static mixers, having relatively small deflection elements, that local concentration differences can be equalized relatively well and quickly. Unfortunately, however, wide-scale concentration differences, for instance between two opposite sides of the flow duct, can only be equalized therein in a very unsatisfactory manner (see German Petty Patent Application G 87 00 259.0).

SUMMARY OF THE INVENTION

It is accordingly an object of the invention to provide a static mixer, which overcomes the hereinafore-mentioned disadvantages of the heretofore-known devices of this general type and which is capable of equalizing both wide-scale and local concentration differences equally, when combined with a shortened intermixing section.

With the foregoing and other objects in view there is provided, in accordance with the invention, a static mixer assembly, comprising a flow duct having a given transverse extent and an axis of symmetry; and a static mixer being disposed in the flow duct and defining a free piece of the flow duct disposed downstream of or in a run-on zone or after flow of the static mixer as seen in flow direction through the static mixer; the static mixer including: a multiplicity of deflection elements being small in relation to the given transverse extent; the deflection elements being disposed in a plane being aligned at an angle relative to the axis of symmetry and, within this plane, in mutually parallel rows being aligned transversely to the axis of symmetry; and the deflection elements of each of the rows being inclined in the same direction or equidirectionally along or parallel to the row and in a counterdirection or a direction opposite to the deflection elements of respective directly adjacent rows.

This means that both wide-scale concentration differences and local concentration differences in the run-on zone are equalized equally well. Wide-scale concentration differences are eliminated in this case by the gas currents which traverse the whole of the flow duct, directly adjacent gas currents which run in counterdirections. That is to say that the traversing gas currents run along identically aligned deflection elements. Local concentration differences are equalized, by contrast, at the limits or borders of the opposite-running flow directions by means of a marginal vortex. The overall result of this is that the path distance covered by the gas, up to the individual components being fully mixed, in the flow direction behind the deflection elements, is made particularly small. That is to say that the piece of free flow duct is made particularly small.

In accordance with another feature of the invention, the deflection elements are inclined by about 10° to 45° in relation to axes being perpendicular to the direction of the rows and perpendicular to the axis of symmetry of the flow duct. This feature helps to produce rapid intermixing.

In accordance with a further feature of the invention, the rows reach from one limit or border wall to the opposite limit or border wall of the flow duct. A wide-scale concentration equalization is thereby promoted and the deflection elements are small in relation to the given distance between adjacent ones of the mutually parallel rows.

In accordance with an added feature of the invention, the deflection elements are fastened on a supporting grid extending transversely to the axis of symmetry of the gas duct. This construction is relatively simple, stable and space-saving to install.

In accordance with an additional feature of the invention, two respectively directly adjacent rows of deflection elements are disposed in pairs tightly next to each other. The turbulence in the region of these deflection elements is thereby heavily intensified, which is tantamount to a further reinforcement of the local intimate mixing.

In accordance with yet another feature of the invention, the rows of the deflection elements are pairs of rows disposed tightly next to each other, and the deflection elements are directly adjacent each other and reciprocally displaced in a direction of deflection. In this embodiment the deflection elements are small in relation to the given distance between adjacent ones of the mutually parallel pairs of rows.

In accordance with yet a further feature of the invention, the deflection elements are bent one-dimensionally in upon themselves.

In accordance with yet an added feature of the invention, the supporting grid has junction points at which the deflection elements are fastened.

In accordance with yet an additional feature of the invention, the supporting grid has junction points and struts between the junction points, and the deflection elements are fastened on the struts.

In accordance with again another feature of the invention, the flow duct has a given mean diameter, and the deflection elements have edge lengths being less than one-fifth or less than one-tenth of the given mean diameter.

In accordance with a concomitant feature of the invention, the rows of deflection elements being inclined in the same direction are aligned diagonally relative to the supporting grid.

Other features which are considered as characteristic for the invention are set forth in the appended claims.

Although the invention is illustrated and described herein as embodied in a static mixer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
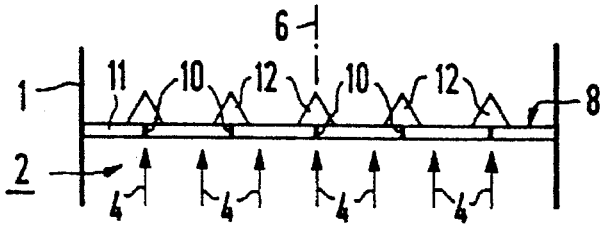
FIG. 3 is a longitudinal-sectional view taken along a line III—III of FIG. 1, in the direction of the arrows.
Figure 1:
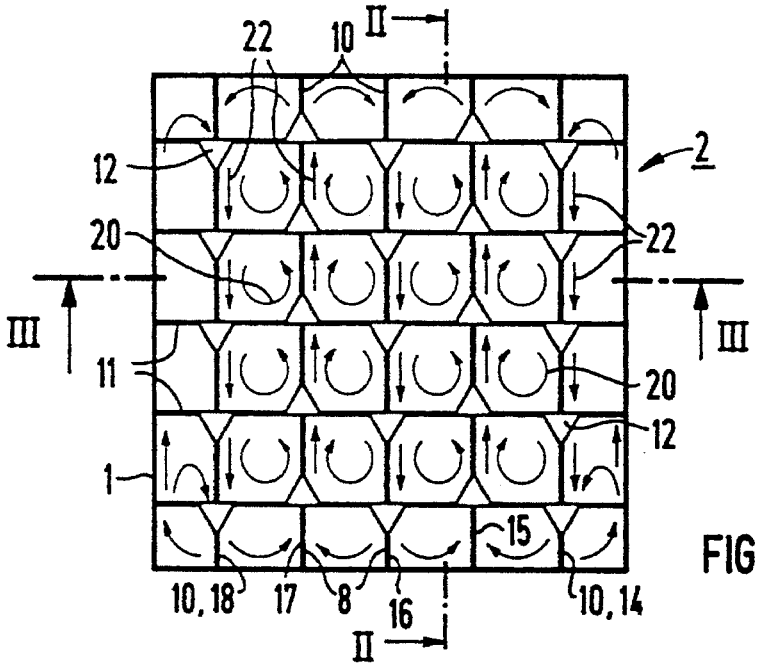
FIG. 1 is a top-plan view of a static mixer installed in a rectangular flow duct.
Figure 2:
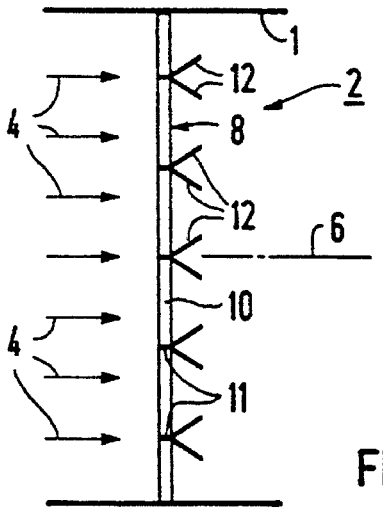
FIG. 2 Is a longitudinal-sectional view taken along a line II—II of FIG. 1, in the direction of the arrows.
Figure 6:
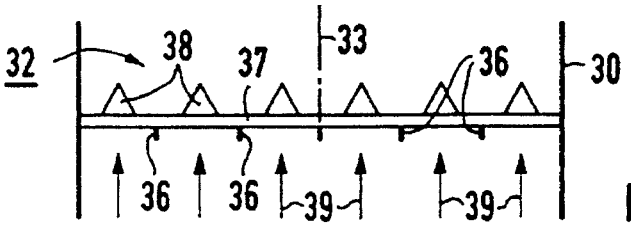
FIG. 6 is a longitudinal-sectional view taken along a line VI—VI of FIG. 4, in the direction of the arrows.

Referring now to the Figures of the drawing in detail and first, particularly, to FIG. 1 thereof, there is seen a top view of a static mixer 2 according to the invention, which is installed in a rectangular flow duct, that in this case is a gas duct 1. In the representation of FIG. 1, the direction of view is chosen counter to the flow direction of a gas current 4. This flow direction can be identified in the sectional views, i.e. in FIGS. 2 and 3. In the top view shown in FIG. 1, it can also be seen that in the gas duct 1, perpendicular to an axis of symmetry 6 thereof, there is inserted a supporting grid 8 being formed of struts 10, 11. In the illustrative embodiment, the struts 10, 11 are made from flat steel and are positioned at right angles to one another. Welded to junction points of the struts 10, 11 of the supporting grid 8 are triangular, sheet-metal deflection elements 12. As the representations of FIGS. 2 and 3 illustrate, these deflection elements 12 are welded on the flow-off or downstream side of the supporting grid 8. It can be seen from FIGS. 1 and 2 that the deflection elements 8 are inclined by about 30° relative to the axis of symmetry 6 of the gas duct 1. FIG. 1 shows that the deflection elements 12 are disposed in rows on the supporting grid 8 and the deflection elements of each row 14, 15, 16, 17, 18 are inclined equidirectionally in the row relative to the principal flow direction 4. The deflection elements of the respectively adjacent rows are inclined in the opposite direction, but by the same angle of inclination. It is furthermore conspicuously apparent that the deflection elements are very much smaller in their dimensions or in terms of their edge length than the dimensions of the gas duct 1. In the illustrative embodiment, the edge lengths of the deflection elements 12 are less than one-tenth of the width or length of the gas duct 1. The edge lengths can amount to up to one-fifth of the mean transverse extent of the flow duct.

During operation of the static mixer 2, i.e. whenever the gas with the components to be mixed is flowing through the static mixer, as is indicated by the arrows 4 in FIGS. 2 and 3, the deflection elements 12 of each row 14, 15, 16, 17, 18 induce a cross or transverse flow 22 in the gas duct 1. The cross flow reaches from one limit or border of the gas duct up to the opposite limit or border. The rows of deflection elements 12 which are respectively directly adjacent thereto produce just such a cross flow 22 from one limit or border of the gas duct 1 to the opposite limit or border, but with the reverse flow direction. A wide-scale exchange of substances is thereby achieved transversely through the whole of the gas duct 1 over the shortest possible distance. At the same time, the counter-running flow directions of the gas give rise at their limits or borders to ring vortices 20, which ensure intimate local intermixing. The gas currents which run transversely through the gas duct and are responsible for the wide-scale intermixing, are indicated in FIG. 1 by straight arrows denoting the cross flows 22, whereas the vortices responsible for the local intimate mixing are indicated in FIG. 1 by circular arrows denoting the vortices 20.

Figure 4:
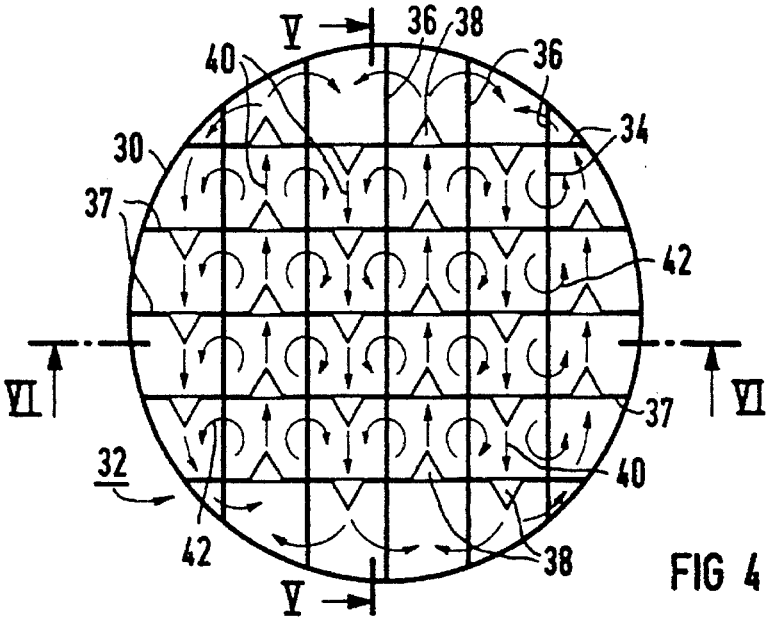
FIG. 4 is a top-plan view of a static mixer installed in a pipe.
Figure 5:
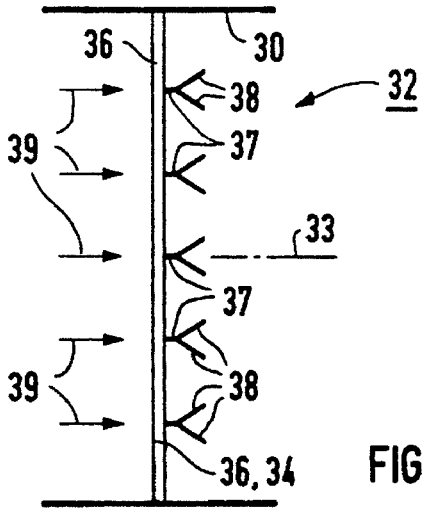
FIG. 5 is a longitudinal-sectional view taken along a line V—V of FIG. 4, in the direction of the arrows.

FIG. 4 shows a top view of another static mixer 32 according to the invention, which is installed in a tubular gas duct 30. In this case too, the static mixer 32 includes a supporting grid 34, which is made up of struts 36, 37 that are positioned perpendicular to one another and is installed perpendicular to an axis of symmetry 33 of the gas duct 30. Deflection elements 38 are fastened to these struts. Unlike the illustrative embodiment of FIGS. 1 to 3, the transverse struts 36 in this case are welded below the longitudinal struts 37 and the deflection elements 38 are welded therebetween to the longitudinal struts 37, not to the junction points of the struts of the supporting grid. In this case too, the deflection elements 38 are disposed in rows and the deflection elements of each row are mutually identical and are inclined in the opposite direction to the deflection elements of the respectively adjacent row.

During operation of this static mixer 32, when the deflection elements 38 are bombarded by a gas current 39, in a similar manner to that of the illustrative embodiment of FIGS. 1 to 3, a cross or transverse current 40 which is generated by each row of identically inclined deflection elements 38 is directed transversely to the gas duct, traverses the whole of the gas duct 30 and runs precisely oppositely to the respectively adjacent cross current. It is noted that in FIG. 4 straight arrows indicate the cross or transverse current 40. Small, local vortices 42 are generated as is shown by circular arrows, in order to ensure intimate local intermixing between two respective mutually adjacent cross currents 40. The configuration of the deflection elements between the junction points of the struts 36, 37 is somewhat simpler, in terms of production technology, than the configuration based on the illustrative embodiment according to FIGS. 1 to 3. As far as the mixing function is concerned, there is no significant difference between the two variations. Both static mixers 2, 32 can also be installed in a rectangular gas duct 1, instead of in a tubular gas duct 30, and vice versa.

Figure 7:
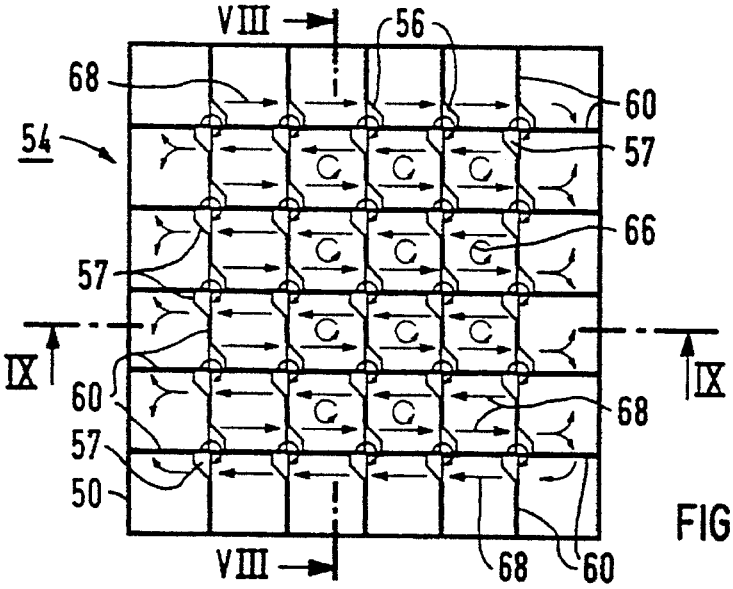
FIG. 7 is a top-plan view of a static mixer, inserted in a rectangular flow duct, exhibiting reinforced local turbulence.

FIG. 7 shows a top view of another static mixer 54 according to the invention, which is installed in a rectangular gas duct 50 and is perpendicular to an axis of symmetry 52. In this case too, deflection elements 56, 57 are fastened on a supporting grid 58 that is made up of struts 60 which are aligned perpendicular to one another. In this case too, the deflection elements 56, 57 are disposed in rows, wherein the deflection elements of one and the same row are all inclined in the same direction transversely to the gas current 62 and the deflection elements 56, 57 of the respectively adjacent row are all inclined in the respectively opposite direction relative to the gas flow.

Figure 9:
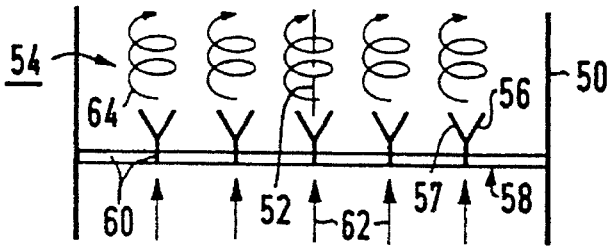
FIG. 9 is a longitudinal-sectional view taken along a line IX—IX of FIG. 7, in the direction of the arrows.
Figure 8:
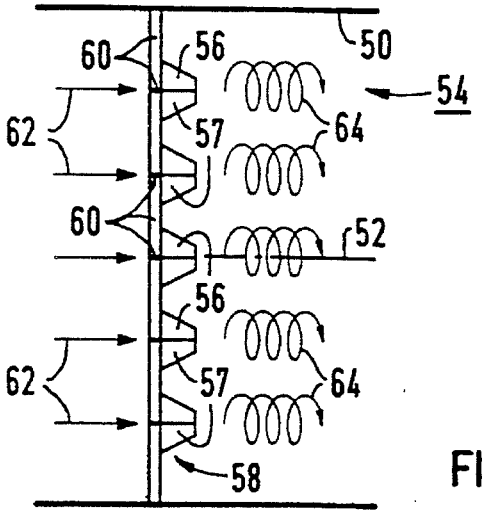
FIG. 8 is a longitudinal-sectional view taken along a line VIII—VIII of FIG. 7, in the direction of the arrows.

However, unlike the illustrative embodiments according to FIGS. 1 to 6, the deflection elements 56, 57 of the two respectively adjacent rows are brought close together and in this case are at the same time reciprocally displaced somewhat in the direction of deflection of the gas current 62. The inclinations of the two respective deflection elements 56, 57 of adjacent rows, which deflection elements have been brought close together, are directed away from each other. The configuration can best be seen with the aid of FIGS. 7, 8 and 9.

During operation of this static mixer 54, the gases to be mixed flow through the supporting grid 58 with the deflection elements 56, 57, in an upwards direction from beneath the plane of projection as seen in the representation of FIG. 7, and this gas flow 62 is deflected in the region of the deflection elements 56, 57, i.e. in the region of the grid junction points, on two sides of the deflection elements, in opposite directions transversely to the gas current 62. This is indicated by straight arrows 68. By virtue of the fact that the deflection elements at the two sides of the junction points of the supporting grid 58 are inclined away from one another, part of the cross current makes its way into the suction region of the respectively directly adjacent deflection element. This gives rise to an intensive turbulence between these two deflection elements, which manifests itself above the deflection elements in a spiral vortex 64. This spiral vortex can be clearly identified in FIGS. 8 and 9. In addition, analogously to the illustrative embodiments of FIGS. 1 and 4, in this case further rotating vortices 66 are generated between the opposite cross flows 68 at the limit or border of the cross flows.

While there are no significant differences from the two illustrative embodiments according to FIGS. 1 and 4 in relation to the wide-scale intermixing of the gas current, a severe intensification can be detected with regard to the local mixing, in the illustrative embodiment of FIG. 7. This intensification of the local mixing by the generation of a large number of small, very intensive spiral vortices 64, expresses itself in a very slight increase in the flow resistance of this static mixer 54. In return for this, however, the run-on, follower or downstream section, behind which one can talk about complete intermixing of the gas current, in this case has been shortened somewhat further relative to the first two illustrative embodiments.

Figure 10:
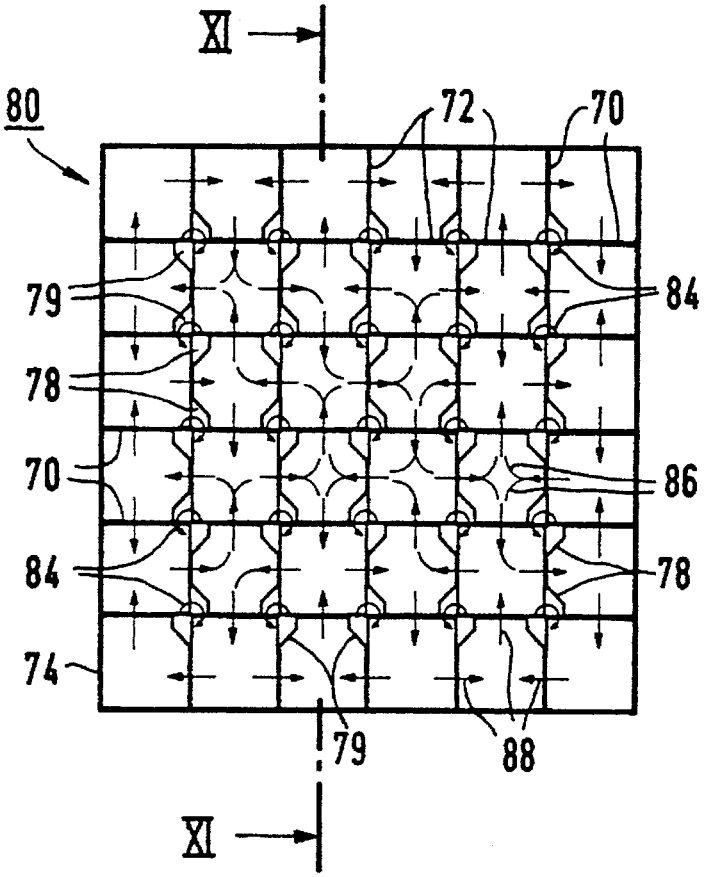
FIG. 10 is a top-plan view of a mixer having rows of deflection elements disposed diagonally relative to the supporting grid.
Figure 11:
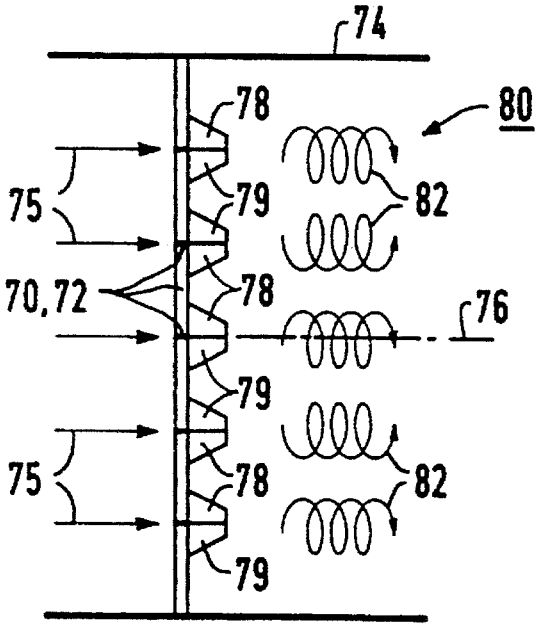
FIG. 11 is a longitudinal-sectional view taken along a line XI—XI of FIG. 10, in the direction of the arrows.

FIG. 10 is a top view and FIG. 11 is a side view showing a static mixer 80 which is a modification of the static mixer 54 of FIG. 7. In this case as well, a flat supporting grid 70, that is made up of struts 72 which are aligned perpendicular to one another, is disposed in a rectangular gas duct 74 that is perpendicular to an axis of symmetry 76 thereof. In this case too, the same deflection elements 78, 79 as in FIG. 7 are disposed in rows and two respective deflection elements 78, 79 of directly adjacent rows are brought close together and are inclined oppositely relative to a primary gas flow 75. However, those pairs of deflection elements 78, 79 which are fastened along the same struts 72 are respectively disposed in a reverse-image configuration, so that non reverse-image pairs of deflection elements can be found only in rows that are diagonal to the supporting grid 70.

During operation of this static mixer 80, the gases to be mixed flow through the supporting grid 70 having the pairs of deflection elements 78, 79 in an upwards direction from beneath the plane of projection in the representation of FIG. 10. As a result of this counter deflection of the gas current 75 at the deflection elements 78, 79 of each pair, a spiral vortex 82 is produced over these pairs. These spiral vortices are indicated in FIG. 10 by circular arrows 84. Since these spiral vortices, at adjacent squares on the supporting grid, have a reverse-image direction of rotation, they induce between themselves cross currents 86 running diagonally relative to the supporting grid. The cross currents are indicated by straight arrows 88. As compared to the other three illustrative embodiments, in the case of this static mixer 80, the intensity of the local intermixing has been reinforced even further to the detriment of the wide-scale intermixing. This static mixer 80 is therefore particularly suitable for the intensive intermixing of substances which are already, to some extent, uniformly mixed in the oncoming gas current.

These static mixers which are shown in this case can also be used in liquid media. In this case, however, the inclination of the deflection elements is somewhat reduced relative to the basic flow. In the case of both liquid and gaseous media, it is advantageous to gradually increase the inclination of the deflection elements from their base up to their head end, i.e. to bend-in the deflection elements upon themselves. The cross flows can thereby be reinforced. The bases are used to fastened the deflection elements to the supporting frame.

The above-disclosed static mixers can not only be used in process engineering for the uniform intermixing of different substance currents, i.e. gases, liquids and/or solids transported therein. On the contrary, in the chemical industry, static mixers of this kind enable more uniform intermixings of different reaction partners to be achieved over relatively short path distances. For instance, the denitrogenation of flue gases in power plants and for garbage incineration can be advantageously influenced by very uniform mixing of the reducing agent, which is generally $NH_3$, with the flue gas.

We claim:

1. A static mixer assembly, comprising:

a flow duct having a given transverse extent and an axis of symmetry; and a static mixer being disposed in said flow duct and defining a free piece of said flow duct disposed downstream of said static mixer as seen in flow direction through said static mixer; said static mixer including:

a) a multiplicity of deflection elements disposed in a plane being aligned at an angle relative to said axis of symmetry and in mutually parallel rows being aligned transversely to said axis of symmetry;

b) said deflection elements of each of said rows being inclined in the same direction along said row and being inclined in a direction opposite to said deflection elements of respective directly adjacent rows;

c) two directly adjacent rows being spaced apart by a given distance;

d) said deflection elements being small in relation to the given distance between adjacent ones of said mutually parallel rows; and e) the given distance being small in relation to the given transverse extent.

2. The static mixer assembly according to claim 1, wherein said deflection elements are inclined by approximately 10° to 45° relative to axes being perpendicular to a direction of said rows and perpendicular to said axis of symmetry of said flow duct.

3. The static mixer assembly according to claim 1, wherein said flow duct has border walls, and said rows reach from one of said border walls to an opposite one of said border walls.

4. The static mixer assembly according to claim 1, including a supporting grid extending transversely to said axis of symmetry of said flow duct, said deflection elements being fastened on said supporting grid.

5. The static mixer assembly according to claim 4, wherein said supporting grid has junction points at which said deflection elements are fastened.

6. The static mixer assembly according to claim 4, wherein said supporting grid has junction points and struts between said junction points, and said deflection elements are fastened on said struts.

7. The static mixer assembly according to claim 4, wherein said rows of deflection elements being inclined in the same direction are aligned diagonally relative to said supporting grid.

8. The static mixer assembly according to claim 1, wherein said flow duct has a given mean diameter, and said deflection elements have edge lengths being less than one-fifth of said given mean diameter.

9. The static mixer assembly according to claim 1, wherein said flow duct has a given mean diameter, and said deflection elements have edge lengths being less than one-tenth of said given mean diameter.

10. A static mixer assembly, comprising:

a flow duct having a given transverse extent and an axis of symmetry; and a static mixer being disposed in said flow duct and defining a free piece of said flow duct disposed downstream of said static mixer as seen in flow direction through said static mixer; said static mixer including:

a) a multiplicity of deflection elements;

b) said deflection elements being disposed in a plane being aligned at an angle relative to said axis of symmetry and in mutually parallel rows being aligned transversely to said axis of symmetry;

c) said rows of said deflection elements are two directly adjacent pairs of rows disposed tightly next to each other;

d) said deflection elements of each of said pairs of rows being inclined in the same direction along one side of said pair of rows and being inclined in a direction opposite to said deflection elements of a respective other side of said pair of rows;

e) two adjacent pairs of rows being spaced apart by a given distance;

f) said deflection elements being small in relation to the given distance between adjacent ones of said mutually parallel pairs of rows; and g) said given distance being small in relation to said given transverse extent.

* * * * *